United States Patent [19]

DeBiasi

[11] Patent Number: 4,969,443

[45] Date of Patent: Nov. 13, 1990

[54] OPEN SECONDARY DETECTION VIA REVERSE CIRCUIT SENSING

[75] Inventor: Charles J. DeBiasi, Allen Park, Mich.

[73] Assignee: Ford Motor Company, Dearborn, Mich.

[21] Appl. No.: 402,317

[22] Filed: Sep. 5, 1989

[51] Int. Cl.[5] ..... F02P 11/00; F02P 17/00

[52] U.S. Cl. ..... 123/481; 73/117.3; 123/630; 324/388; 324/399

[58] Field of Search ..... 123/479, 481, 630, 644, 123/198 D, 198 DB, 198 F; 73/115, 116, 117.3; 324/380, 388, 399

[56] References Cited

U.S. PATENT DOCUMENTS 3,882,840 5/1975 Adamian et al. ..... 123/644
3,938,490 2/1976 Snyder et al. .
4,114,582 9/1978 Rabus et al. .
4,117,819 10/1978 Jarrett et al. .
4,153,032 5/1979 Chateau .
4,359,038 11/1982 Xiberas .
4,886,029 12/1989 Lill et al. ..... 123/630 X
4,918,389 4/1990 Schleupen et al. ..... 324/399

FOREIGN PATENT DOCUMENTS 2060053 4/1981 United Kingdom .

*Primary Examiner*—Tony M. Argenbright
*Attorney, Agent, or Firm*—Peter Abolins; Clifford L. Sadler

[57] ABSTRACT

An open secondary coil of an ignition coil is detected by the use of a reverse current in the primary of the ignition coil to indicate the occurrence of an open secondary coil.

11 Claims, 3 Drawing Sheets

OPEN SECONDARY DETECTION VIA REVERSE CIRCUIT SENSING

BACKGROUND OF THE INVENTION

1. Field of the Invention

This invention relates generally to internal combustion engine ignition systems and, in particular, to ignition systems with an ignition coil.

2. Prior Art

U.S. Pat. No. 3,938,490 discloses an ignition control circuit having an open secondary protective circuit for preventing open circuits in the secondary winding from destroying portions of the ignition system. The patent discloses an open secondary Zener clamp protection circuit, two induction emission systems, and teaches using the coil flyback voltage in order to regulate the primary circuit coil voltage. An open secondary sensor includes a voltage divider network but does not detect a reverse current in the primary for generating a signal indicating an open secondary circuit.

U.S. Pat. No. 4,153,032 teaches sensing current, but not the reverse current in the primary of an ignition circuit, and then comparing the sensed current or voltage with a reference value to control emission. However, there is no open secondary detection performed by the sensing resistor or the comparator. That is, the primary circuit sense resistor is used to control coil energy. The patent teaches only using the sense resistor link conducting current as in the forward direction. There is no teaching of open secondary detection.

Various other patent references are also generally related to the operation of ignition coils within ignition systems.

U.S. Pat. No. 4,114,582 teaches a secondary protection system circuit utilizing a high voltage connection to the secondary circuit.

U.S. Pat. No. 4,117,819 teaches using engine rotation speed information in order to regulate the percent dwell applied to the ignition system. There is no teaching of open secondary detection.

U.S. Pat. No. 4,359,038 teaches a primary coil drive in the clamp circuit which may be incorporated into an introverted circuit to eliminate the need for an external Zener clamp for protection. Open secondary detection is not mentioned.

GB No. 2 060 053 A, providing primary current overload protection by using a forward current through a sense resistor. Again, open secondary detection is not mentioned.

SUMMARY OF THE INVENTION

This invention teaches detecting an open circuit condition in an ignition coil secondary circuit by sensing reverse current flowing in the ignition coil primary circuit. A sense resistor in series with the primary winding of the ignition coil provides a reverse current path for the negative primary voltage reflected back from the open secondary circuit. The reverse current flow produces a negative voltage across the sensing resistor which is compared in a comparator in order to produce an open secondary signal.

Advantageously, a signal indicating an open secondary is used in conjunction with an engine control system so that fuel can be restricted to the cylinders not receiving a spark. If fuel continues to be injected into cylinders which do not receive spark, the fuel may pass through the cylinder and damage the catalyst. The recent introduction of distributorless ignition systems has further increased the significance of this type of fault protection, since an open secondary will affect two cylinders.

DETAILED DESCRIPTION OF THE INVENTION

Figure 1:
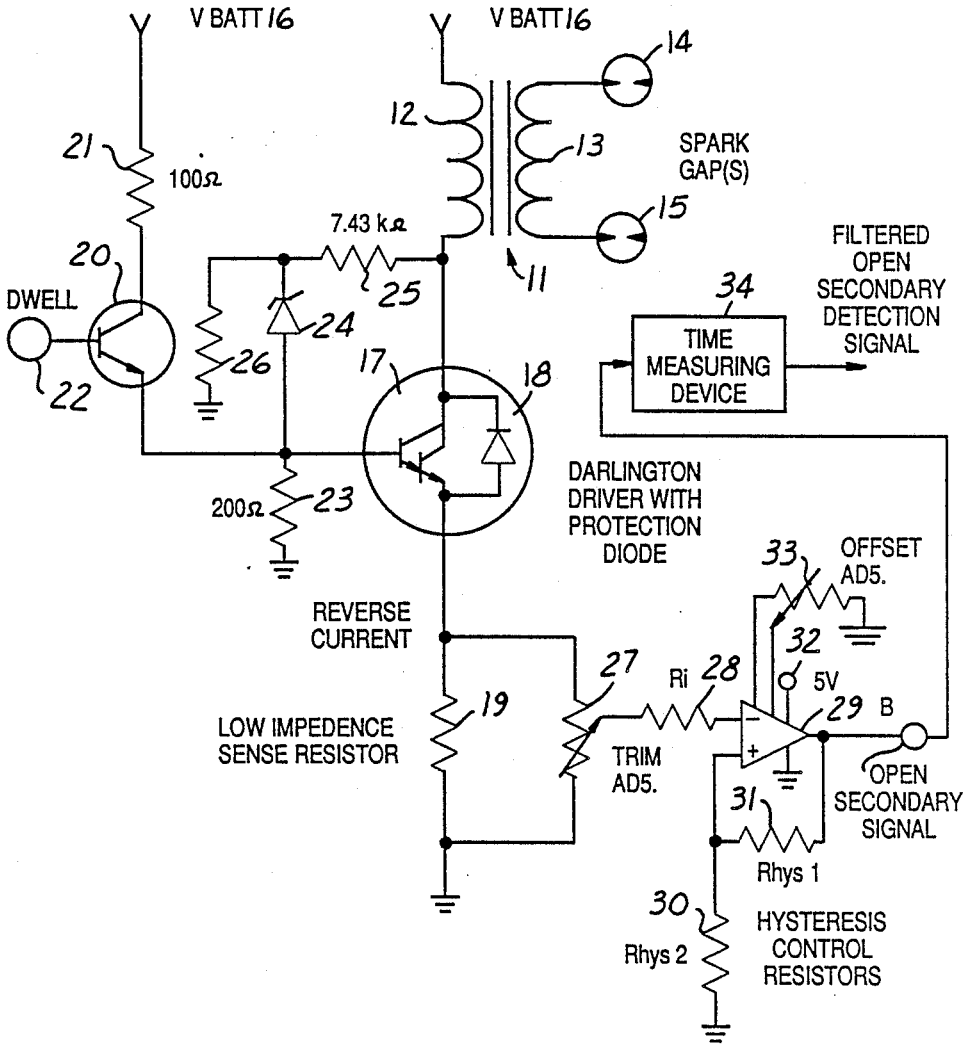
FIG. 1 is a schematic drawing of an ignition system in accordance with the embodiments of this invention.

Referring to FIG. 1, a reverse current sensing open secondary detection circuit 10 includes an ignition coil 11 with a primary winding 12 and a secondary winding 13. A secondary winding 13 is connected in series to spark gaps 14 and 15. Primary winding 12 is connected in series with a battery 16, the parallel combination of a Darlington driver 17 and an internal protection diode 18, and a sense resistor 19. A base input to Darlington driver 17 is connected to battery 16 through the series combination of a collector-emitter circuit of a pre-driver transistor 20 and a series resistor 21. A dwell signal at input 22 is applied to the base of transistor 20. The base of Darlington driver 17 is coupled to ground through a resistor 23. The base of Darlington driver 17 is coupled to the collector of Darlington driver 17 through the series combination of a Zener diode 24 and a resistor 25. The intermediate node between diode 24 and resistor is coupled to ground through a resistor 26. An adjustable trim resistor 27 is coupled in parallel across sense resistor 19. An adjustable pick up terminal from resistor 27 is connected through a resistor 28 to the negative input of a comparator 29. The positive input of comparator 29 is connected to ground through a resistor 30. The output of comparator 29 is coupled back to the positive input of comparator 29 through feedback resistor 31. Comparator 29 is coupled to a 5 volt source 32 and to an offset adjustment resistor 33. The output of the comparator 29 indicates an open secondary signal.

In operation, an open secondary circuit condition is detected by reverse current sensing of the primary circuit. Reverse current sensing refers to sensing ignition module reverse current exhibited when the ignition coil is acting as a current source to the battery. In this mode, current is drawn out of the ignition primary winding 12 and a negative voltage with reference to ground may be detected across current sense resistor 19. By proper adjustments of comparator 29 offset voltage and hysteresis feedback, a single ended supply comparator 29 can be used to detect the negative voltage drop.

This detection scheme uses reflection of stored energy in secondary winding 13 of ignition coil 11 to primary winding 12 and through protection diode 18 and Darlington driver device 17. Under normal spark firing conditions, most of the primary winding energy is magnetically coupled across to secondary winding 13 where the coil energy is discharged across spark gaps 14 and 15. Due to a lack of a complete secondary circuit during an open secondary condition, the coil energy cannot be dissipated as spark but is instead used to charge the capacitance of secondary winding 13. When the breakdown voltage of the secondary capacitance is exceeded, the secondary voltage collapses and an inductive-capacitive resonant oscillation occurs. This voltage is reflected back into primary winding 12.

This reflection induces a negative voltage on primary winding 12 thereby biasing the protection diode 18 in parallel with Darlington driver device 17. With a current path established, a significant amount of remaining energy is conducted out of the ignition coil 11 through primary winding 12, diode 18 and sense resistor 19. The current flow amplitude and direction are exceptionally distinguished and unmistakable. Using a current sense resistor 19 in series with Darlington driver 17 emitter, the negative voltage with reference to ground is detectable with great reliability. Using a linear voltage comparator 29, a digital pulse can be generated to indicate an open secondary. Open circuit secondary detection by reverse primary current sensing is advantageously immune to erroneous fault detection. In addition, optional processing of the duration and relative time of occurrence with respect to the end of dwell may be used to further enhance the reliability of detection. That is, a longer duration secondary detection signal provides increased noise immunity for an indication of an open secondary condition. The output of linear voltage comparator 29 is applied to a time measuring device 34. Device 34 measures the duration of the secondary detection signal and using threshold criteria determines whether or not to indicate an open secondary detection signal at the output of device 34.

Figure 2A:
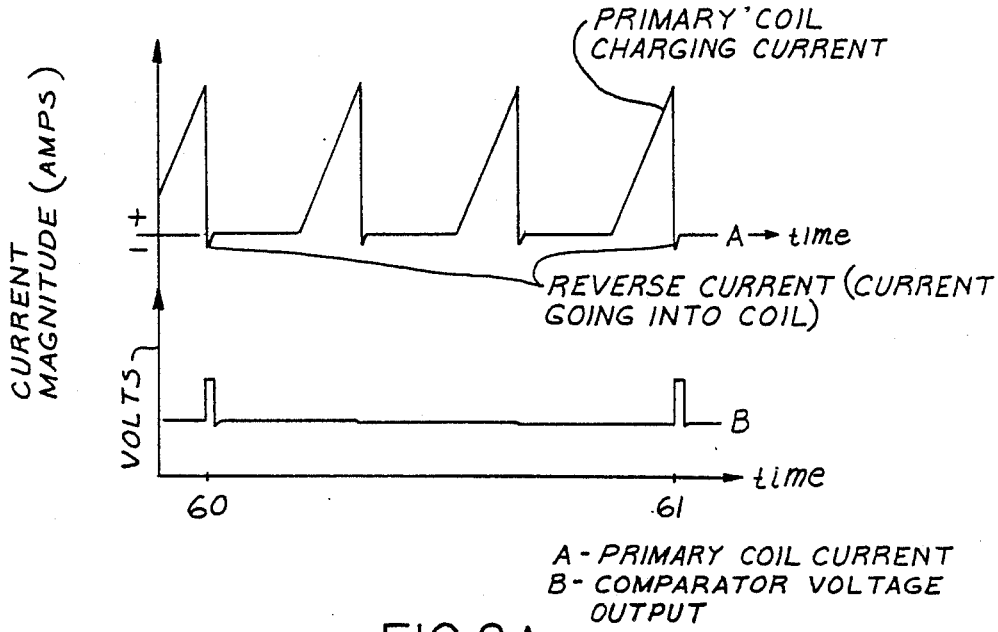
FIGS. 2A and 2B are graphical representations of primary coil current versus the signal indicating an open secondary.

Referring to FIG. 2A, the signal A on top indicates primary charge current and the signal B on the bottom indicates an open secondary detection signal, both with respect to time. When the primary coil charge current of signal A has a negative magnitude, there is indicated a reverse current, i.e. a current which has a direction the reverse of normal coil charging current. If this reverse current is sufficiently large then at the same time there is a corresponding rise in signal B to indicate open secondary detection. Such detection occurs at time 60 and time 61 on FIG. 2A.

Figure 2B:
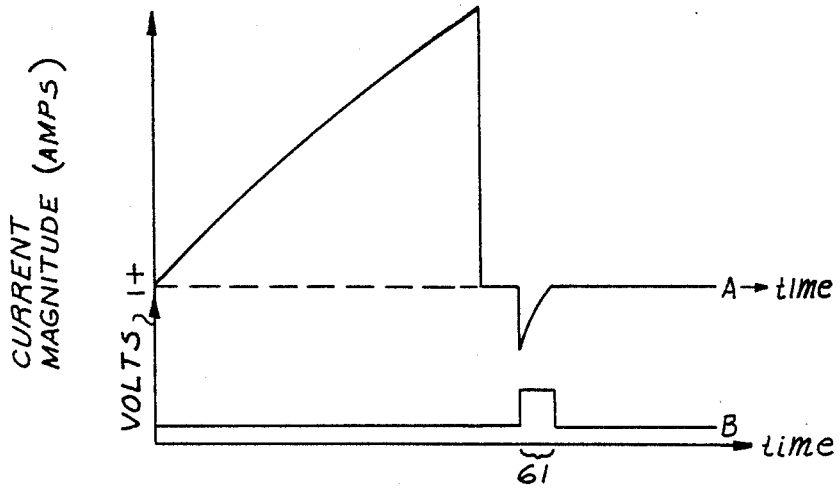
Figure 3:
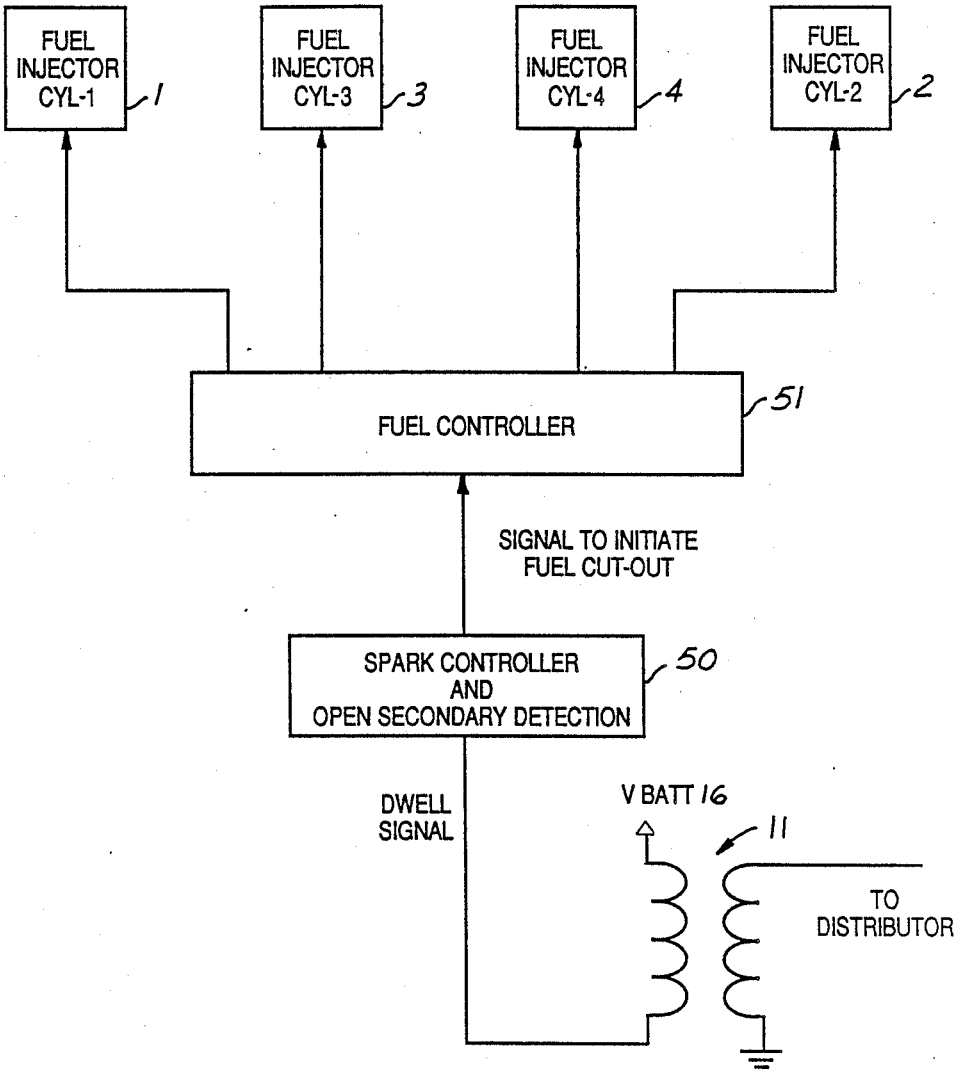
FIG. 3 is a block diagram showing how fuel flows reduce to an engine cylinder when the existence of an open secondary coil is established.

Referring to FIG. 2B, time 61 is expanded so that the rise of signal B corresponding to the reverse current of the primary coil, is more clearly seen. Indeed, the rise in signal A now has a duration which can be detected by time measuring device 34 of FIG. 1 and there can be determination whether there should be an indication of an open secondary detection circuit. That is, a brief noise spike would not have sufficient duration in signal B to cause indication of an open secondary.

FIG. 6 is a block diagram indicating how fuel flow is reduced to engine cylinders in response to detection of an open secondary. Ignition coil 11 is coupled to a spark controller and open secondary detection circuit 50. Circuit 50 is shown in more detail in FIG. 1. Circuit 50 is coupled to a fuel controller circuit 51 which in turn is coupled to fuel injection components 1, 2, 3, and 4 associated with cylinders 1, 2, 3, and 4, respectively. In operation, when spark controller and open secondary detection circuit 50 has detected an open secondary, it provides an output signal to fuel controller circuit 51 to initiate fuel flow reduction. Fuel controller circuit 51 then cuts out fuel at cylinders 1, 2, 3, and 4 as appropriate. Reducing fuel flow in a cylinder which is not sparking is advantages because it reduces gasoline flow without combustion. Such gasoline flow may damage the engine, or the catalyst for reducing emissions, or cause reduced fuel economy.

Various modifications and variations will no doubt occur to those skilled in the arts to which this invention pertains. For example, a particular dwell control of the ignition coil may be varied from that disclosed herein. These and all other such variations which basically rely on the teachings through which this disclosure has advanced the art are properly considered within the scope of this invention.

I claim:

1. A method of detecting an open secondary coil of an ignition coil having a primary coil and a secondary coil including the step of:

detecting a reverse current in the primary ignition coil as an indication of an open secondary coil.

2. A method of detecting an open secondary coil as recited in claim 1 wherein the step of detecting a reverse current includes the steps of:

coupling a sense resistor in series with the primary coil;

coupling the voltage across the sense resistor to a first input of a comparator;

applying a reference voltage to a second input of the comparator; and generating an output from the comparator indicating an open secondary.

3. A method as recited in claim 2 further comprising the steps of:

coupling a hysteresis control feedback path to the comparator; and coupling an offset adjust resistor to the comparator.

4. A method as recited in claim 2 wherein the step of generating an output from the comparator indicating an open secondary includes:

comparing the voltage across the sense resistor to the reference voltage; and indicating an open secondary condition if the voltage across the sense resistor is larger than the reference voltage.

5. An engine control method for an internal combustion engine having fuel injection and an ignition coil including the steps of:

sensing reverse primary current in the primary winding of the ignition coil;

generating a signal indicating the detection of an open secondary winding; and reducing fuel flow to the engine cylinder associated with the open secondary.

6. An engine control method as recited in claim 5 further comprising the step of:

using the duration of the secondary detection signal as a further indication of open secondary conditions.

7. An engine control method as recited in claim 6 further comprising the step of:

measuring the time of occurrence of the secondary signal with respect to the time of occurrence of the end of dwell signal in order to further filter and discriminate open secondary conditions.

8. An engine control method for an internal combustion engine having fuel injection and an ignition coil including the steps of:

sensing reverse primary current in the primary winding of the ignition coil;

generating a signal indicating an open secondary winding;

reducing fuel flow to the engine cylinder associated with the open secondary;

using the duration of the secondary detection signal as a further indication of open secondary conditions; and measuring the time of occurrence of the secondary signal with respect to the time of occurrence of the end of dwell signal in order to further filter and discriminate open secondary conditions.

9. An engine ignition system including:

an ignition coil having a primary winding and a secondary winding;

a sense resistor coupled in series with said primary winding;

a diode coupled in series between said sense resistor and said primary winding to pass reverse primary winding current; and a detection means coupled to said sense resistor to detect sense resistor voltage and generate an output indicating an open secondary winding circuit.

10. An engine ignition system as recited in claim 9 further comprising:

a time means coupled to said detection means for determining the duration of the detection signal and using the determination as an indication of an open secondary condition.

11. An engine ignition system including:

an ignition coil having a primary winding and a secondary winding;

a sense resistor coupled in series with said primary winding;

a diode coupled in series between said sense resistor and said primary winding to pass reverse primary winding current;

a detection means coupled to said sense resistor to detect sense resistor voltage and generate an output indicating an open secondary winding circuit;

a time means coupled to said detection means for determining the duration of the detection signal and using the determination as an indication of an open secondary condition;

a fuel controller being coupled to said detection means for governing fuel flow actuation signals; and a fuel injector coupled to said fuel control means operating in response to signals received from said fuel controller means.

* * * * *